US006649237B1

(12) United States Patent
Pahl et al.

(10) Patent No.: US 6,649,237 B1
(45) Date of Patent: Nov. 18, 2003

(54) MAT CONSISTING OF TUBES

(75) Inventors: Bernd Pahl, Hamburg (DE); Helmuth Blank, Seevetal (DE)

(73) Assignee: Phoenix AG, Hamburg (DE)

( * ) Notice: Subject to any disclaimer, the term of this patent is extended or adjusted under 35 U.S.C. 154(b) by 0 days.

(21) Appl. No.: 09/857,920

(22) PCT Filed: Sep. 21, 2000

(86) PCT No.: PCT/DE00/03289

§ 371 (c)(1),
(2), (4) Date: Jun. 11, 2001

(87) PCT Pub. No.: WO01/29319

PCT Pub. Date: Apr. 26, 2001

(30) Foreign Application Priority Data

Oct. 18, 1999 (DE) ..... 199 50 253

(51) Int. Cl.[7] ..... B32B 3/20; B32B 3/26; E01B 9/68; E01B 9/38

(52) U.S. Cl. ..... 428/36.8; 428/159; 428/172; 428/187; 428/188; 238/109; 238/114; 238/283; 238/382

(58) Field of Search ..... 428/36.8, 188, 428/187, 159, 172; 238/283, 382, 109, 114

(56) References Cited

U.S. PATENT DOCUMENTS 5,023,128 A * 6/1991 Fatool ..... 428/172
5,195,679 A * 3/1993 Leeves et al. ..... 238/283
5,735,457 A * 4/1998 Bohm et al. ..... 238/283
5,738,279 A * 4/1998 Ihle et al. ..... 238/382
5,965,238 A * 10/1999 Saitoh et al. ..... 428/178

FOREIGN PATENT DOCUMENTS

| | | | |
|---|---|---|---|
| DE | 33 45 388 | 6/1985 | |
| DE | 34 03 234 | 8/1985 | |
| DE | 35 24 719 | 1/1987 | |
| EP | 0 569 867 | 11/1993 | |
| EP | 0 672 789 | 9/1995 | |
| EP | 805016 A1 * | 11/1997 | ..... B29C/65/08 |
| WO | WO98/45537 | 10/1998 | |

* cited by examiner

*Primary Examiner*—Sandra M. Nolan
*Assistant Examiner*—Chris Bruenjes
(74) *Attorney, Agent, or Firm*—Collard & Roe, P.C.

(57) ABSTRACT

A tube mat made of elastomer material in the form of an extrudate includes first and second front faces which are arranged in a vertical or angled manner in relation to the extrusion direction. A plurality of tubes extend in parallel in the extrusion direction between the two front faces. At least a portion of each tube is closed at adjustable distances whereby a closed air column respectively is formed and whereby the tube seal together with the tube mat forms a one-piece elastomer composite. A method for producing the tube mat is also provided in which after the extrusion, the tubes are closed at certain points by means of pressure and a pad roller, whereby beads and closing webs are produced. The pad roller is provided with pins that are distributed over the circumference of the roller. Vulcanization is carried out subsequently.

13 Claims, 3 Drawing Sheets

SECTION AA

SECTION A-A

SECTION B-B

MAT CONSISTING OF TUBES

Applicants claim the benefit as a National stage entry of a PCT application pursuant to 35 U.S.C. §371 of International Application No. PCT/DE00/03289 filed Sep. 21, 2000, published in the German language, which in turn claims priority in its parent case, German Application No. 199 50 253.6 filed Oct. 18, 1999.

BACKGROUND OF THE INVENTION

1. Field of the Invention

The invention relates to a tube mat made of elastomer material in the form of an extruded product, comprising at least a first face side and a second face side, which are arranged perpendicular or at an angle in relation to the direction of extrusion, as well as a plurality of tubes extending between the two face sides parallel with the direction of extrusion.

2. The Prior Art

A tube mat of the type specified above is described, for example in the published documents DE-C-33 45 388; DE-C-34 03 234; DE-C-35 24 719; and EP-B-0 569 867.

In conjunction with the tube mats known until now, it was possible for dirt and water to penetrate the tube mat on the face sides, which then frequently led to the fact that the tube mat was no longer capable of fully satisfying its function with respect to its elasticity.

SUMMARY OF THE INVENTION

Now, the problem of the invention is to provide a tube mat in connection with which the penetration of dirt and water is excluded to the greatest possible extent, combined with an improvement of the elastic properties of the article and, at the same time, a longer useful life, all this under permanent dynamic stress.

Said problem is solved in that at least a part of the tubes are closed at adjustable intervals, specifically with formation of an enclosed air column in each case, whereby the closure of the tube forms a one-piece elastomer composite with the tube mat.

The closure of the tube may extend in this connection in one line perpendicular or at an angle unequal to 90° in relation to the direction of extrusion, preferably at an angle of from 45° to 80°.

Particularly the following two variations are employed with respect to the tube closure:

The first and the second face sides of the tube mat are closed, specifically with formation of a completely sealed tube system.

The first and/or the second face side(s) are/is partially or completely open, specifically with formation of a correspondingly open face zone. However, a sealed tube system is present in the center zone of the tube mat.

The following materials are usefully employed for the tube mat:

The tube mat consists of a vulcanized rubber mixture based on ethylene-propylene-diene copolymer (EPDC), whereby the hardness in Shore A amounts to 30° to 50°.

The alternative material is a vulcanized rubber mixture based on natural rubber (NR), whereby the hardness in Shore A amounts to 30° to 60° in the present case.

Additional mixing ingredients usually contained in the rubber mixture are, for example sulphur or sulphur donors, accelerators, zinc oxide, fillers and anti-aging agents.

The tube mat as defined by the invention is applied particularly in the field of rail traffic technology, specifically within the framework of vibration and sound damping in the following areas of application:

The tube mat serves as an elastic mat in the railroad bed or ballast. Under this aspect, the tube mat is referred also as a railroad bed mat or below-ballast mat. The mat may be covered in this connection by a protective layer of fleece or the like, if need be.

The tube mat has the function of an elastic insert in crosstie systems.

Furthermore, the tube mat serves as an elastic substrate in rail support sites, in particular again in the form of a rail substrate that is arranged underneath the foot of the rail.

Furthermore, the problem of the invention is to provide for the tube mat of the type described above a method that assures a safe closure of the tubes, and which is economical.

A particularly advantageous method for producing the tube mat as defined by the invention is characterized by the following steps of the method:

Following extrusion, the tubes are pressed shut with the help of a pressure applicator roller that is provided with pins which are distributed over the circumference of the roller, specifically with the formation of beads or closing bridges; and vulcanization is carried out subsequently.

BRIEF DESCRIPTION OF THE DRAWINGS

Other advantageous parameters of the method are introduced in the following within the framework of the description of the figures. In the drawing.

DETAILED DESCRIPTION OF PREFERRED EMBODIMENTS

Figure 1:
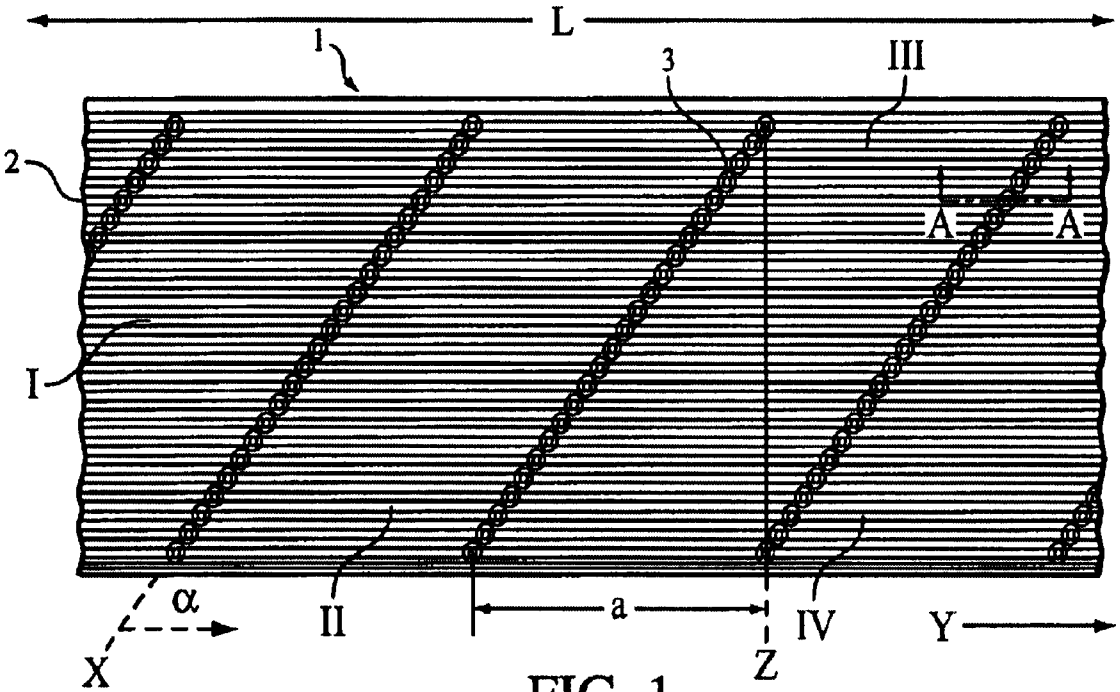
FIG. 1 shows a tube mat with closure of the tubes along lines at an angle unequal to 90° in relation to the direction of extrusion.

The following list of reference numerals applies in on with said figures:

1 Tube mat
2 Tubes
3 Tube closure
4 Top side of tube mat
5 Bead
6 Bridge of closure
11 First face side of the tube mat
12 Second face side of the tube mat
13 Extruder with outlet opening
14 Support rollers
15 Pressure applicator roller
16 Pins
17 Vulcanization channel FIG. 1 shows a tube mat 1 made of elastomer material, i.e. of rubber or a material similar to rubber. Said tube mat is an extruded product with the extrusion direction "Y". A length "L" of up to 100 m is realizable in this connection.

The tube mat 1 has a plurality of tubes 2 extending parallel with the extrusion direction "Y". The tubes are closed in this connection at the adjustable intervals "a", specifically with formation of an enclosed air column in each case. In the present case, the tube closure 3 extends in a line "X" at an angle "4" of about 55° in relation to the extrusion direction "Y". A plurality of closed tube segments I, II, III and IV are produced in this way.

Now, the following two possibilities are available within the framework of a cut through the article:

The cut is made along line "X" through the center of the tube closure 3. This produces a face side of the tube mat that is completely closed.

The cut is made along line "Z" perpendicular to the extrusion direction "Y". This produces a tube segment III that is open within the face side of the tube mat. This, however, can be accepted if the tube mat has at least one closed tube segment, in particular a plurality of closed tube segments connected in series. This is the case also when the tube mat 1 is employed as a railroad bed mat, or below-ballast mat.

Figure 2:
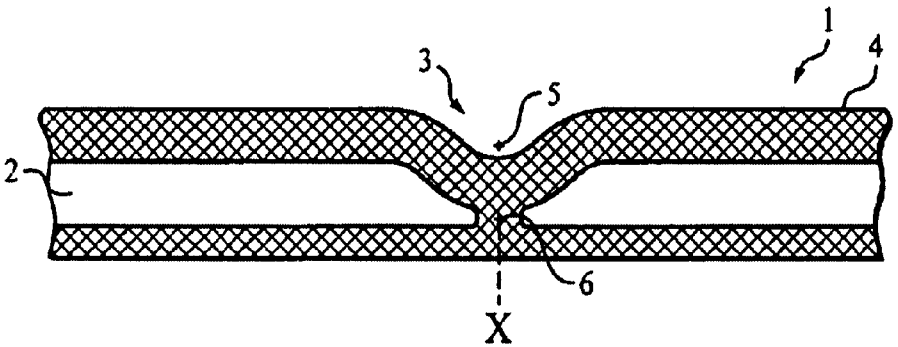
FIG. 2 shows details of the tube closure according to section line A—A in FIG. 1.

FIG. 2 shows the tube closure 3, whereby a bead 5 is formed on the top side 4 of the tube mat 1 within the zone of the closure. The tube closure as such is caused by the closing bridge 6.

Now, if the article is cut along the line "X" through the center of the closing bridge 6, a closed face side of the tube mat 1 is produced.

Figure 3:
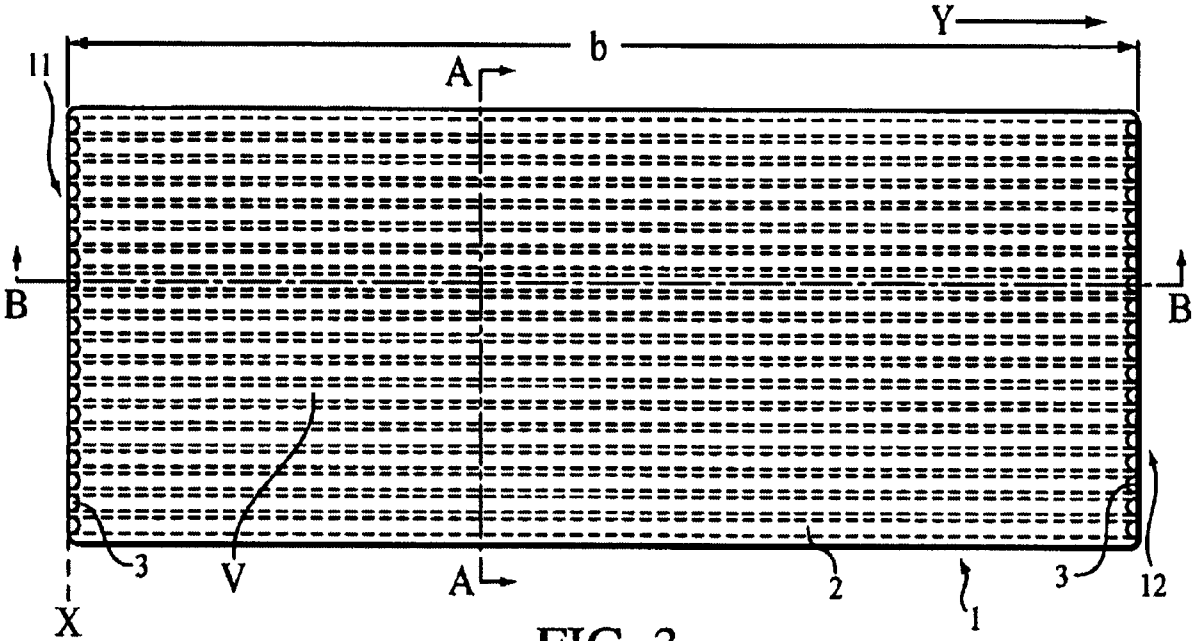
FIG. 3 shows a tube mat with closure of the tubes along a line perpendicular to the direction of extrusion.

FIG. 3 shows a tube mat 1 with tubes 2. In the manufacture of this tube mat, which is initially produced in the form of a web-shaped structure, several tube closures 3,3 are formed which, as opposed to the exemplified embodiment according to FIG. 1, extend in a line "X" perpendicular to the extrusion direction "Y". The tubes 2 are closed in this connection at an adjustable interval "b", specifically with formation of a closed tube segment "V".

Now, within the framework of said exemplified embodiment, the article is cut along the line "X", whereby a first face 11 and a second face side 12 are formed, which each are completely closed. Only one single closed tube segment V is present in this connection.

Such a tube mat is employed, for example as an elastic insert in crosstie shoe systems.

Figure 4:
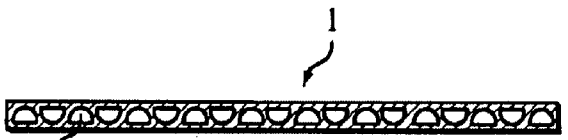
FIG. 4 shows a tube mat according to section line A—A in FIG. 3.

FIG. 4 shows the cross section (A—A) of the tube mat 1 according to FIG. 3, whereby the tubes 2, viewed in the cross section, substantially have the shape of a semicircle specifically in an alternative arrangement of the structure. However, tubes with another cross sectional shape (e.g. circular) are possible as well.

Figure 5:
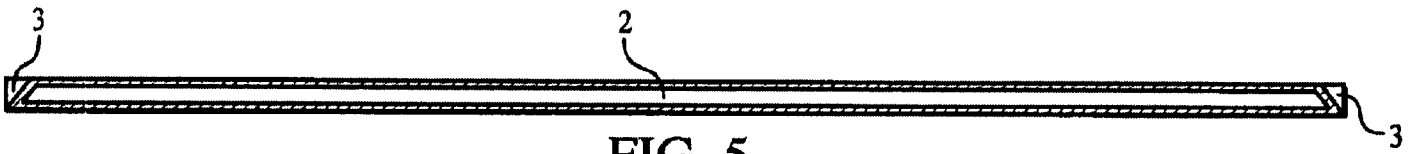
FIG. 5 shows a tube mat according to section line B—B in FIG. 3.

Now, FIG. 5 shows a longitudinal section (B—B) through the tube mat 1 according to FIG. 3, specifically with formation of a closed tube 2. The same applies with respect to the tube closure 3,3 as to the tube closure 3 according to FIG. 2.

Figure 6:
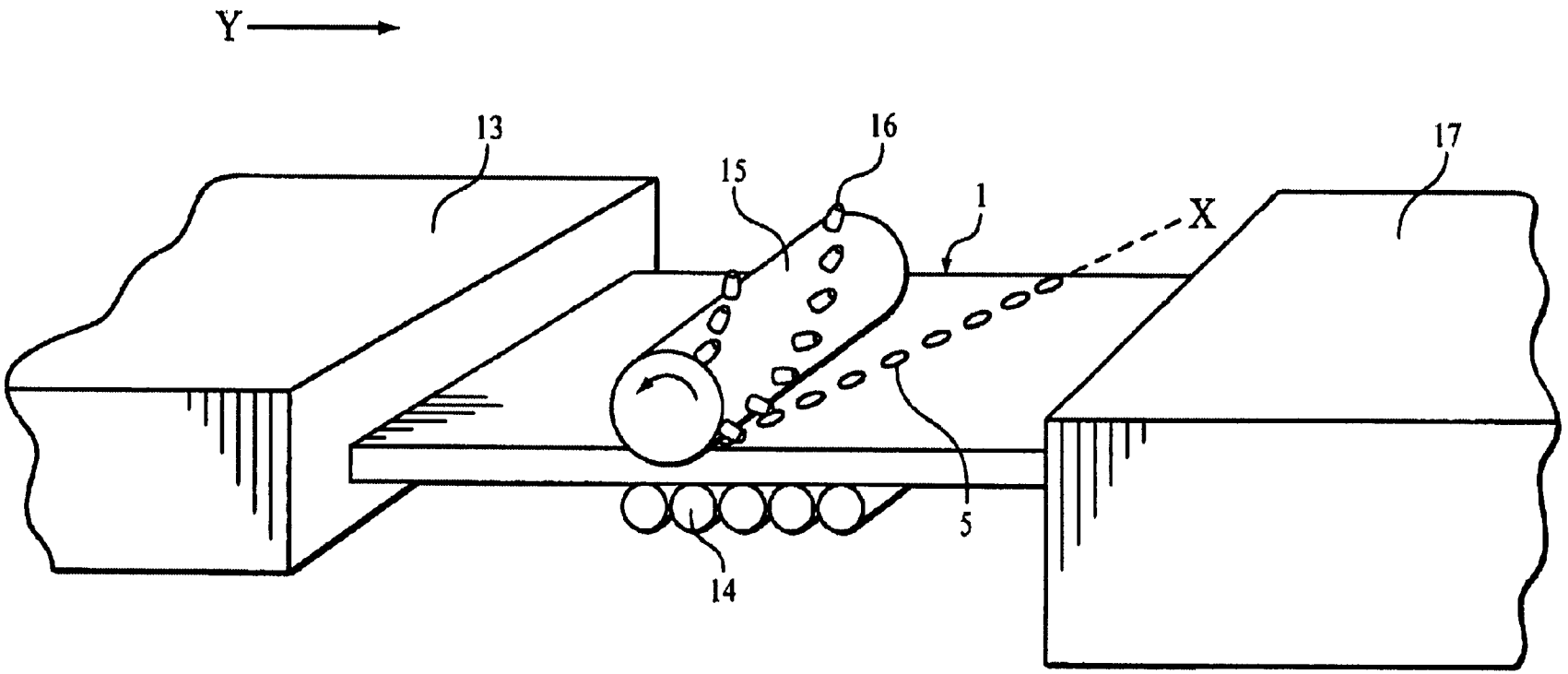
FIG. 6 shows a diagram illustrating the manufacture of a tube mat according to FIG. 1.

Now, FIG. 6 describes the technical sequence of the method for producing a tube mat 1 according to FIG. 1.

The web-shaped tube mat 1 exits from the extruder 13 in the extrusion direction "Y". The tube mat is now guided on a supporting sliding system particularly in the form of the support rollers 14. A pressure applicator roller 15, which is provided with the pins 16 distributed over the circumference of the roller, now presses the tubes shut in points (i.e. exclusively within the zone of the closure), specifically with formation of the beads 5 and the closing bridges 6 (FIG. 2). The tube closure 3 (FIGS. 1, 2) extends in this connection in a line "X" at an angle unequal to 90°.

The tube mat 1 then enters a vulcanization channel 17. The vulcanization is carried out without pressure in this connection in the UHF-channel, in a salt bath installation, or in a hot air installation.

The pins 17 are advantageously exchangeable. Pins with a diameter of, for example 20 mm have been successfully used in connection with railroad bed mats or below-ballast mats.

With another arrangement principle of the pressure applicator roller 15 and the pins 16 it is possible also to realize a tube closure 3 that extends in a line "X" perpendicular to the extrusion direction "Y".

What is claimed is:

1. A tube mat for vibration and sound damping in rail traffic technology, said tube mat being made of elastomer material in the form of an extrudate having a length, which comprises:

(a) a first face side and a second face side arranged perpendicular to or at an angle with the length of the extrudate; and (b) a plurality of tubes extending in parallel along the length of the extrudate between the two face sides;

wherein a portion of the tubes are closed at adjustable intervals to form in each case an enclosed air column, whereby the tube closure forms a one-piece elastomer composite with the tube mat;

wherein said tube mat comprises a web-shaped structure extending along the length of the extrudate; and wherein the first and/or the second face sides are partially or completely open to form a correspondingly open face area and a closed tube system is formed in the center area of the tube mat.

2. The tube mat according to claim 1, wherein the first and the second face sides are closed to form a completely closed tube system.

3. The tube mat according to claim 1, wherein the tube closure extends at an angle $\alpha$ unequal to 90° in relation to the length of the extrudate.

4. The tube mat according to claim 3, wherein the tube closure extends at an angle of from 45° to 80° in relation to the length of the extrudate.

5. The tube mat according to claim 1, wherein the mat consists of a vulcanized rubber mixture based on ethylene-propylene-diene copolymer (EPDC).

6. The tube mat according to claim 5, wherein the hardness in Shore A amounts to 30° to 50°.

7. The tube mat according to claim 1, wherein the mat consists of a vulcanized rubber mixture based on natural rubber (NR).

8. The tube mat according to claim 7, wherein the hardness in Shore A amounts to 30° to 60°.

9. The tube mat according to claim 1, wherein the tube closure extends perpendicular to the length of the extrudate.

10. The tube mat according to claim 9, wherein the mat is covered with a protective layer.

11. The tube mat according to claim 10 wherein the protective layer is a fleece.

12. An elastic insert for a crosstie shoe system comprising the tube mat according to claim 1.

13. An elastic substrate for a rail support site adapted to be arranged underneath the foot of a rail which comprises the tube mat according to claim 1.

* * * * *